US011166539B2

(12) United States Patent
Clary

(10) Patent No.: US 11,166,539 B2
(45) Date of Patent: Nov. 9, 2021

(54) BACKPACK WITH DEPLOYABLE CHAIR

(71) Applicant: Michael W. Clary, Phoenix, MD (US)

(72) Inventor: Michael W. Clary, Phoenix, MD (US)

( * ) Notice: Subject to any disclaimer, the term of this patent is extended or adjusted under 35 U.S.C. 154(b) by 0 days.

(21) Appl. No.: 16/155,941

(22) Filed: Oct. 10, 2018

(65) Prior Publication Data

US 2019/0104829 A1 Apr. 11, 2019

Related U.S. Application Data

(60) Provisional application No. 62/570,316, filed on Oct. 10, 2017.

(51) Int. Cl.

| | |
|---|---|
| ***A45F 4/02*** | (2006.01) |
| ***A47C 1/14*** | (2006.01) |
| ***A47C 7/62*** | (2006.01) |
| ***A45F 3/04*** | (2006.01) |
| ***A45F 3/00*** | (2006.01) |
| ***A47C 7/58*** | (2006.01) |

(52) U.S. Cl.

CPC ..... *A45F 4/02* (2013.01); *A45F 3/04* (2013.01); *A47C 1/146* (2013.01); *A47C 7/58* (2013.01); *A47C 7/622* (2018.08); *A45F 2003/003* (2013.01); *A45F 2004/026* (2013.01)

(58) Field of Classification Search

CPC ..... A45F 4/02; A45F 2004/026; A45F 2003/003; A45F 3/04; A45F 3/08; A47C 1/146; A47C 7/622; A47C 7/58

USPC ..... 297/382, 380, 228.1, 219.1, 252

See application file for complete search history.

(56) References Cited

U.S. PATENT DOCUMENTS

| | | | | | |
|---|---|---|---|---|---|
| 2,051,494 | A * | 8/1936 | Mitchell | A47C 7/425 | 297/382 |
| 2,865,433 | A * | 12/1958 | Warner | A47C 1/16 | 383/25 |
| 4,208,070 | A | 6/1980 | Geschwender | | |
| 4,410,214 | A | 10/1983 | Geschwender | | |
| 5,588,570 | A * | 12/1996 | Zirbel | A45F 4/02 | 224/155 |
| 5,702,153 | A * | 12/1997 | Pliska | A47C 7/425 | 297/256.16 |
| 5,868,465 | A * | 2/1999 | Kvalvik | A47D 15/006 | 297/228.1 |
| 6,547,110 | B2 * | 4/2003 | O'Hare | A45F 3/08 | 224/155 |
| 6,843,398 | B2 * | 1/2005 | Zion | A45F 3/08 | 224/155 |

(Continued)

*Primary Examiner* — Milton Nelson, Jr.

(74) *Attorney, Agent, or Firm* — Royal W. Craig; Gordon Feinblatt LLC

(57) ABSTRACT

A dual-configuration chair and backpack having at least one storage compartment with a back panel and a bottom panel held in rigid orientation to each other at a predetermined angle by an integral tubular frame having a two generally U-shaped frame portions fixed at the selected angle. A deployable seat is rotatably affixed to a lower edge of the back panel and includes a flat foam cushion formed at an angle complementary to the angle between the back and bottom panels of the backpack. When used as a seat the flat serves as a cushion under the buttocks of the user. When used as a backpack the flat is rotated up to the back panel such that the complementary angles position the cushion for proper lumbar and back support of the backpack load.

9 Claims, 6 Drawing Sheets

(56) References Cited

U.S. PATENT DOCUMENTS

| | | | | |
|---|---|---|---|---|
| 6,913,312 | B2 * | 7/2005 | Clary | A47C 1/146<br>297/118 |
| 2002/0113103 | A1 * | 8/2002 | O' Hare | A45F 3/08<br>224/155 |
| 2006/0081663 | A1 * | 4/2006 | Chiang | A45F 4/02<br>224/155 |
| 2010/0252589 | A1 * | 10/2010 | Popescu | A45F 4/02<br>224/155 |

* cited by examiner

BACKPACK WITH DEPLOYABLE CHAIR

CROSS-REFERENCE TO RELATED APPLICATION(S)

The present application claims priority from U.S. Provisional Patent Application 62/570,316 filed Oct. 10, 2017, the disclosure of which is incorporated by reference herein in its entirety.

BACKGROUND OF THE INVENTION

1. Field of the Invention

The present invention relates to a frame supported backpack incorporating a deployable chair and more specifically to an ergonomically designed backpack/chair with improved comfort in both its worn and seated uses.

2. Description of the Background

Lightweight, collapsible and portable seating in the nature of lawn chairs, beach chairs and stadium seats are fairly well-known in the art. For example, U.S. Pat. No. 4,208,070 to Geschwender discloses a leg-less leisure chair with a generally L-form, one-piece frame having a fabric cover and a cushion swing-able relative to the frame. The chair may be used in two different positions on the floor: a first in which the short leg of the L engages the ground surface while the long leg extends upward as a back support and the cushion serves as a seat, and a second position in which the short leg slopes upward from the ground to meet the long leg which then extends back down to the ground to form a inclined surface with the cushion serving as a headrest on the incline. Geschwender improved this design in U.S. Pat. No. 4,410,214 by suggesting a collapsible four-piece frame including a pair of long U-form frame portions and an air of short L-form connectors adapted for a telescopic fit in the ends of the U-form frame portions to form the L-form frame. Geschwender's '214 patent also teaches a basic removeable cover for holding the frame together.

U.S. Pat. No. 6,913,312 to M. Clary issued Jul. 5, 2005 shows the Back Jack™ floor chair which includes an articulating knock-down frame and an improved cover design for a chair. The frame includes a pair of separate generally U-form frame portions, one being a seat and the other a backrest, and a pair of generally L-form connectors adapted for a telescopic spring-biased fit with the U-form portions. The U-form frame portions are chamfered about their ends to ease installation of the cover and to prevent tearing. The cover fits over the frame and holds the component parts in assembly. The cover includes a top panel section sewn against a bottom panel section, and a side panel section sewn there between to form an enclosure for holding an integral cushion.

The above-described chairs have been well-received and are portable, lightweight and in most instances, spring-collapsible. It would be greatly advantageous to incorporate a portable, lightweight chair into a backpack, but the repeated need to assemble and disassemble the prior art chairs makes this a difficult proposition. It would be greatly advantageous to provide a combination backpack with deployable leisure chair, and to refine the design to allow the frame to be inserted into the fully finished backpack to thereby reduce the cost, simplify assembly, and increase the useful life of the chair.

SUMMARY OF THE INVENTION

It is, therefore, an object of the present invention to provide a combination backpack and chair incorporating a low-profile frame and articulating seat into a pattern for an integral backpack cover that is particularly configured for ease of manufacture, unobtrusive low-profile wear as a conventional backpack, simple deployment for use as a chair without affecting the contents of the backpack, and sturdy, safe and secure seating thereon.

According to the present invention, the above-described and other objects are accomplished by providing a dual-configuration chair and backpack having at least one main storage compartment with a back panel and a bottom panel held in rigid orientation to each other at a predetermined acute angle by an integral tubular frame having two generally U-form frame portions fixed at the selected angle. A deployable seat includes a sleeve pivotally affixed to a lower edge of the back panel and a flat foam cushion inserted therein, pivotable from a horizontal seated angle to an upright vertical stowed angle complementary to the angle between the back and bottom panels of the backpack. When used for seating the deployable seat serves as a cushion under the buttocks of the user. When used as a backpack the flat seat is pivoted up against and affixed to the back panel such that the complementary angles position the cushion for proper lumbar and back support of the backpack load.

BRIEF DESCRIPTION OF THE DRAWINGS

Other objects, features, and advantages of the present invention will become more apparent from the following detailed description of the preferred embodiment and certain modifications thereof, in which.

DETAILED DESCRIPTION OF THE PREFERRED EMBODIMENTS

Figure 1:
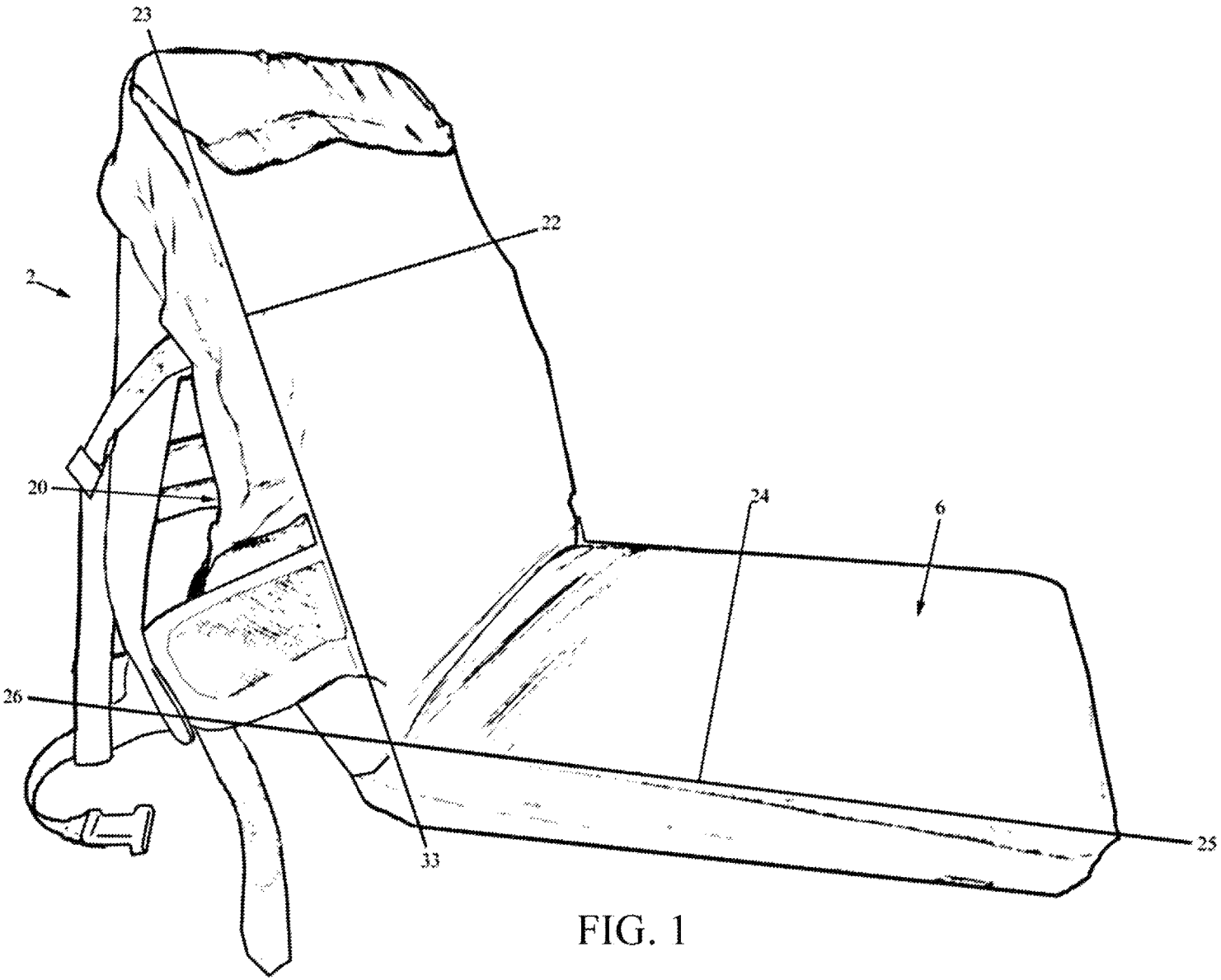
FIG. 1 is a perspective side view of a backpack with integral chair deployed according to an embodiment of the invention.
Figure 2:
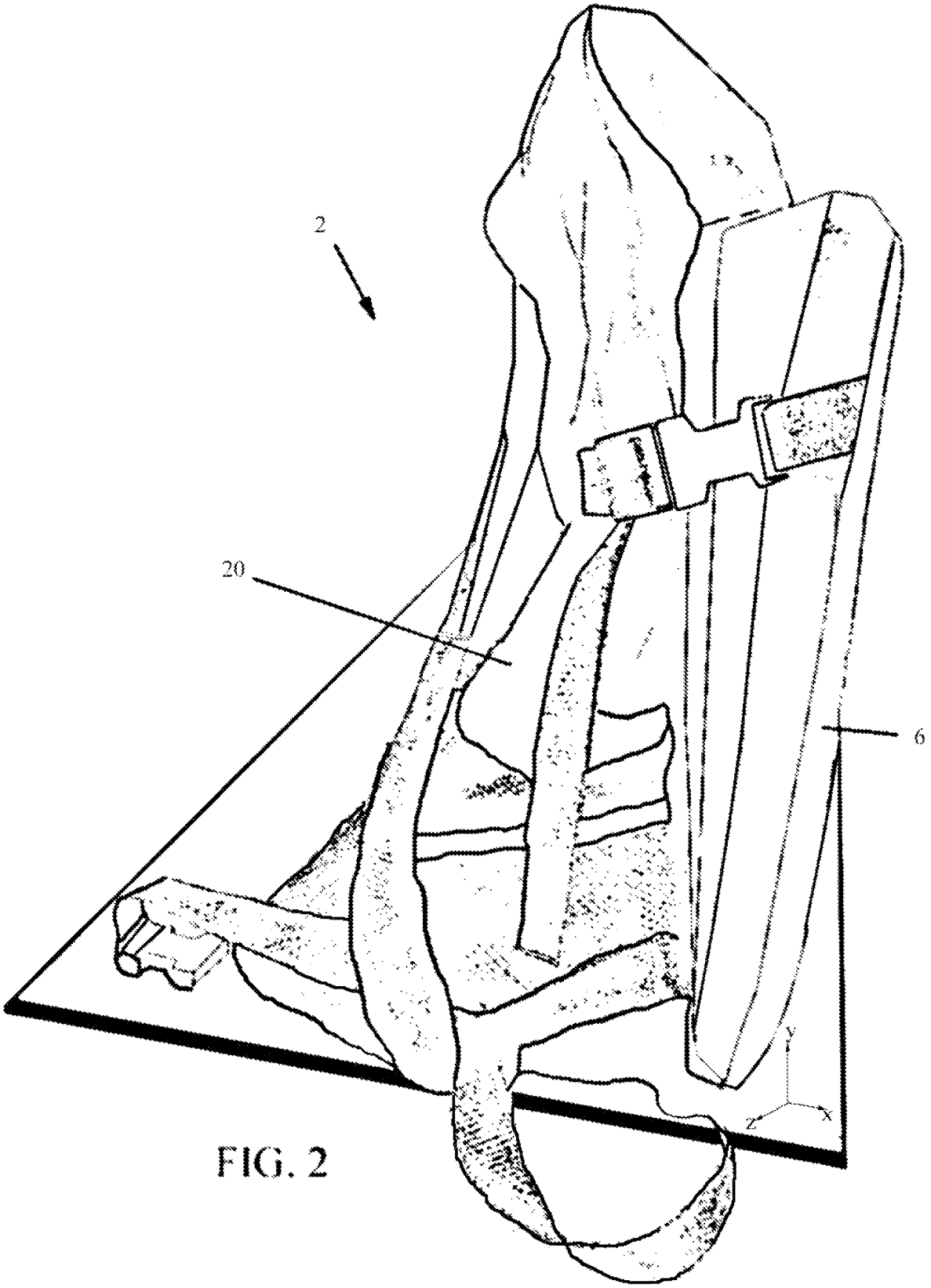
FIG. 2 is a perspective side view of the backpack with integral chair of FIG. 1 with chair retracted.
Figure 3:
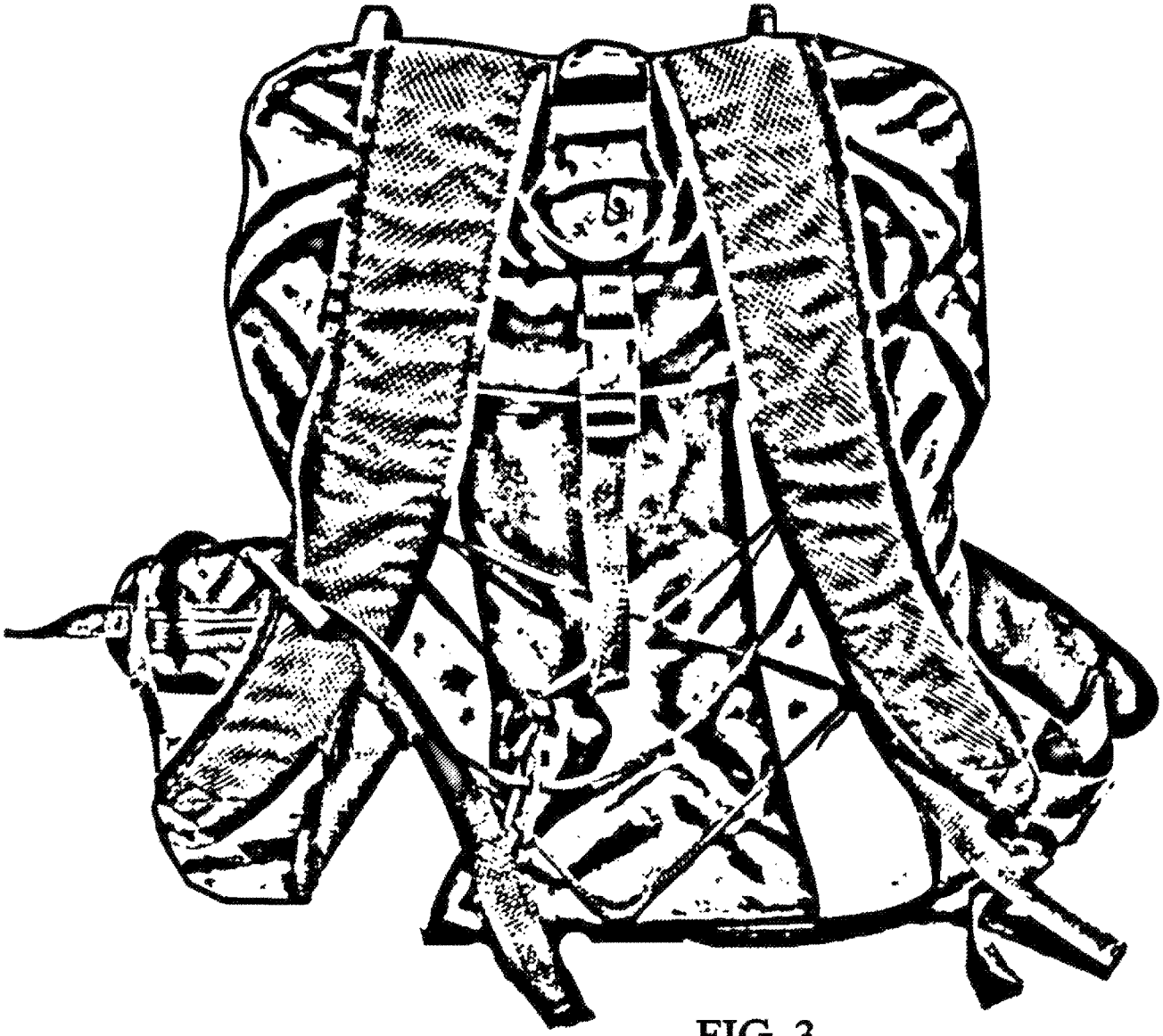
FIG. 3 is a perspective front view of the backpack with straps inverted to accommodate deployment of the chair of FIG. 1.

With combined reference to FIGS. 1-2 and 6-7, a dual-configuration chair according to the present invention comprises a fabric backpack 2, an integral frame 4 (dotted lines in FIGS. 6-7), and a deployable flat seat 6, all of which are easy to manufacture and to assemble. The backpack 2 is preferably constructed of a durable, lightweight and flexible woven or non-woven fabric material such as nylon (e.g., Codura™, rip-stop), cotton canvas, polyester pack-cloth, PVC, or leather formed to enclose at least one main storage area or pocket 20, although those skilled in the art will recognize that multiple pockets and/or partitions of varying size can be provided to improve the item-carrying utility of the design. The enclosure of the pocket 20 is integrally formed in part by a backplane 22 having a top edge 23 and a bottom edge 33 (FIGS. 6-7), and a bottom plane 24 having a front edge 25 and a back edge 26. The backplane 22 and the base plane 24 are preferably fabric panels as described above and are supported relative to one another by the frame 4 such that the back edge of the bottom plane is joined to or continuous with the bottom edge backplane in an inclined L-form configuration, conforming to the frame 4.

Figure 5:
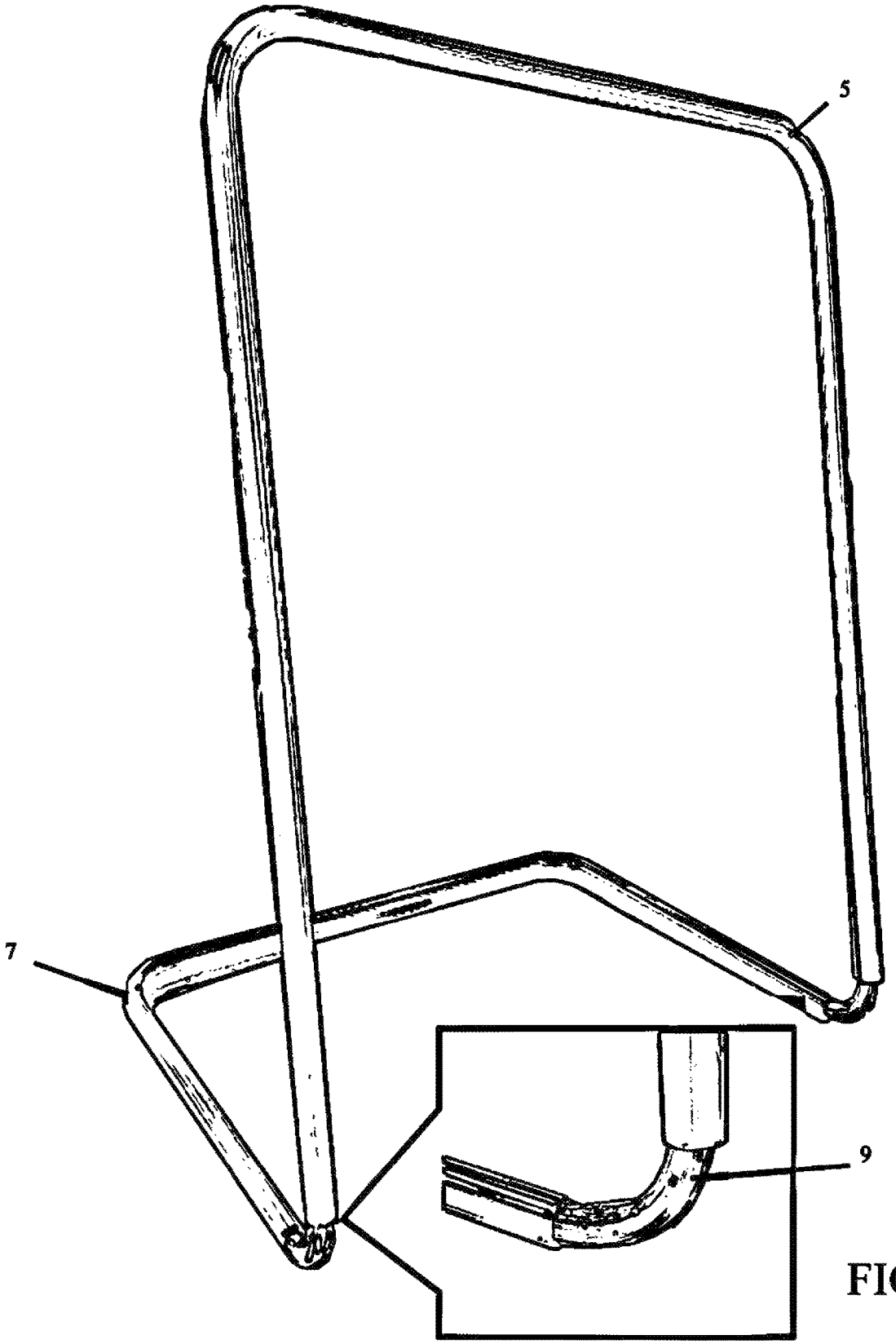
FIG. 5 is a perspective view of the frame for the integral chair of FIG. 1.

With additional reference to FIG. 5, the frame 4 generally includes a first U-shaped frame portion 5 and a second U-shaped frame portion 7. Both of the frame portions 5, 7 are preferably formed of round metallic tubing of substantially uniform diameter along the entire length. The tubes are preferably cold forged. A pair of angle connectors 9 connect the ends of the frame portions 5, 7 to form a rigid L-shaped frame as viewed from the side. The angle connectors 9 are also cold forged elbows, and are fitted to be friction-fit into the ends of the tubular frame portions 5, 7. The included angle between the legs of each connector 9 is acute, preferably from 65°-85°, and more preferably from 70°-80°. This compels the acute angle of the frame 4, such that when standing on the lower frame portion 7 on a horizontal surface the upstanding frame portion 5 is tilted rearward from vertical at an offset angle within a range preferably from 25°-15°, and more preferably from 20°-10°. As an optional feature of the present invention, the annular rim at both ends of both of the U-shaped frame portions 5 and 7 may be outwardly chamfered or beveled to ease insertion.

In addition to chamfering, it has been found that powder-coating or zinc-plating is an optional benefit. The value of zinc or powder coating as a rust-proof finish for steel has long been known. This is because the zinc/powder forms a continuous coating over the whole article. Zinc also creates a tenacious oxide skin. The rust proof qualities of the coating prolongs the life of the tubing. It has also been found that the zinc or powder-coated skin is an excellent fabric lubricant for the cover. The plating/coating eases assembly of the frame components as well as installation of the cover. Once the cover is on the plating/coating lubricates around the joints to help prevent tearing.

The inset to FIG. 5 illustrates the connection of the optionally zinc/powder-coated and optionally chamfered ends of U-form frame members 5, 7 via connector 9 in accordance with the present invention. The chamfering is best accomplished by grinding the rim around its periphery. The chamfered ends of the U-form frame portions 5 and 7 greatly facilitate insertion of the cover 2 as will be described, and it reduces the risk of tearing of the backpack 2 during assembly and use.

Figure 7:
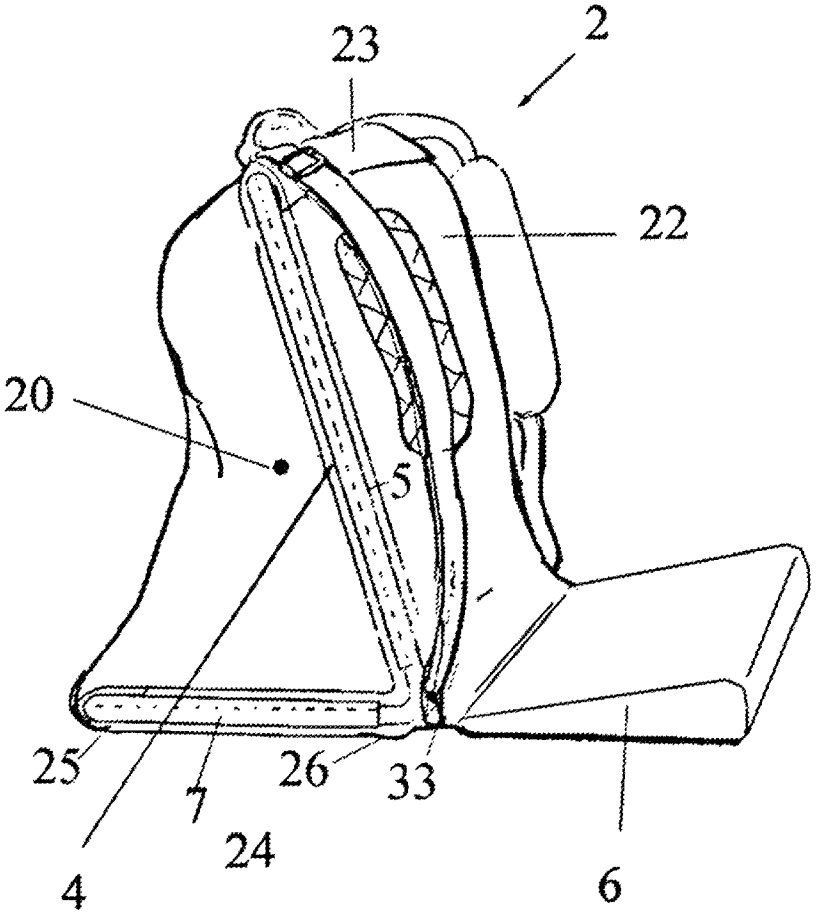
FIG. 7 is a partial cutaway isometric view of a backpack with integral chair in the deployed position.
Figure 6:
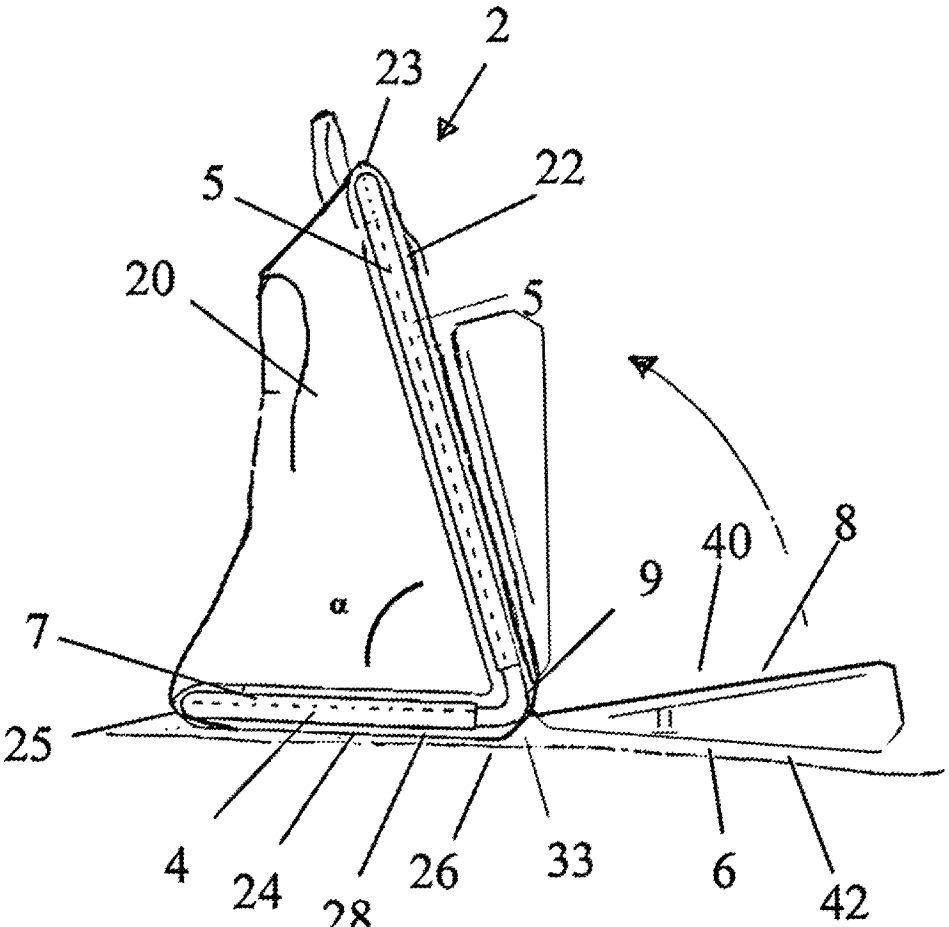
FIG. 6 is a partial cutaway side view of a backpack with integral chair in both the deployed and stowed positions and indicating movement from one position to the other.

With renewed reference to FIGS. 6-7, the backplane 22 and the base plane 24 are affixed to and held generally taught in a planar configuration by the U-form frame portions 5 and 7 of the frame 4. In a preferred embodiment the backplane 22 and the base plane 24 are each constructed from one or more layers of fabric to form a sleeve 28 in which the U-form frame portions 5 and 7 are received to support the backplane and base plane. The sleeve 28 is preferably continuous about the bottom edge 33 of the backplane 22 to the front edge 25 of bottom plane 24 so as to slidably receive the frame 4 in its fully-assembled configuration.

Figure 4:
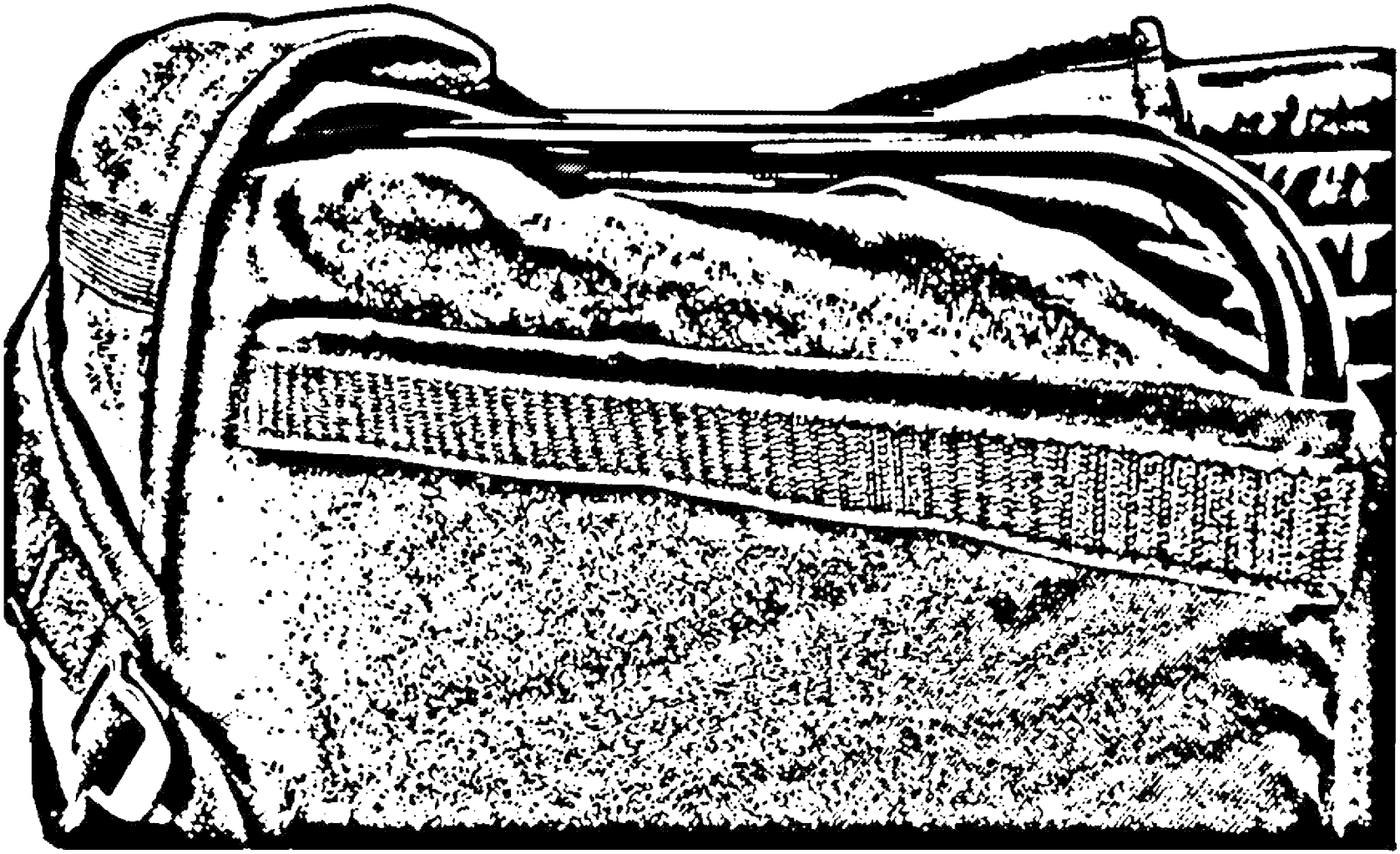
FIG. 4 is a perspective view of the backpack revealing a portion of the frame for the integral chair of FIG. 1.

As shown in FIG. 4, the frame 4 is inserted downward into a transverse access slot 27 at the upper edge 23 of the backplane 22, which access slot is normally closed by a zipper, hook-and-loop fastener or the like. With the U-shaped frame portions 5 and 7 of the frame 4 in place the backplane 22 is held generally taught as noted, the backplane 22 extends at an included acute angle $\alpha$ relative to the base plane 24 equal to that between U-shaped frame portions 5 and 7—that is, preferably from 65°-85° and more preferably from 70°-80°. As indicated above and shown in FIG. 6, when the base plane 24 is resting on a horizontal surface the upstanding backplane 22 and frame portion 5 is tilted rearward from vertical at an offset angle $\omega$ within a range preferably from 25°-15°, and more preferably from 20°-10°.

Again with reference to FIG. 6, a seat 6 is provided preferably in the form of a flat cushion 8 slidably inserted into a pivoting sleeve 11 rotatably affixed to the bottom edge 33 of the backplane 22. The cushion 8 is substantially flat and rectangular, rounded at its outer end, and slidably inserted into the sleeve 11. When inserted into sleeve 11 the seat 6 is rotatable between a deployed position and a stowed position as depicted in FIG. 6. Importantly, the use of a pivoting sleeve 11 open from inside the backpack pocket 20 makes insertion of the cushion 8 easy. When the seat 6 is deployed on a horizontal surface its upper surface 40 is flat to promote a positive seat pan angle, which helps the user to maintain good contact with the backrest. When pivoted to a stowed position the flat-foam seat cushion 8 provides a cushioned back support when the user wears the backpack 2.

The flat cushion 8 may be constructed of any of a number of resilient foam paddings that will be familiar to those skilled in the art such as latex or polyurethane foams and may preferably be wrapped within a protective fabric casing 9 typically constructed of the same or similar material as the backpack 2. When so constructed the seat is stitched to or integrally formed with the fabric of the backpack at the bottom edge 33 so as to be rotatable between a deployed position and a stowed position as depicted in FIG. 6. Alternately, the cushion 6 may be secured to the bottom edge 33 of the backplane 22 by nylon webbing or other flexible connector.

When deployed to seat-mode as seen in FIGS. 1, 3, 6 and 7, the lower surface 42 of the seat 6 and the bottom plane 24 are generally engaged with the ground surface and the backplane 24 extends upward supported by the frame 4 at the predetermined angle offering back support to a person seated on the cushion 8. A pair of backpack straps 50 typically secured between the upper edge 23 and lower edge 33 of the backplane 22 are not needed in this configuration and can be flipped back out of the way as in FIG. 3.

When the user desires to relocate, the seat 6 is rotated to the stowed position (as indicated by the arrow in FIG. 6) with its upper surface 40 engaged to the backplane 22 and secured in position as by hook-and-loop fastener, straps, clips or the like. With the seat 6 in this position the complementary angles of the flat shape and the frame 4 present the lower surface 42 as a cushioned back support when the user wears the backpack 2, thereby properly engaging the back of the wearer when worn with the shoulder straps 50 over the shoulder of the wearer in the conventional manner. The length of the seat 6 is preferably selected to be at least 14-16 inches so as to engage the lower back muscles (latissimus dorsi) of the wearer but may extend the full height of the backplane 22 to further distribute the load of the pack on the back of the wearer.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A dual-configuration chair, comprising a backpack having a storage compartment having a first fabric panel defining a backplane, and a second fabric panel defining a bottom plane diverging from said backplane at an acute angle, and a third fabric panel overlying said first fabric panel and second fabric panel to create a sleeve extending along said backplane and bottom plane around said acute angle, a continuous tubular frame having a first generally 11-shaped frame portion and a second generally U-shaped frame portion attached together end-to-end, said first U-shaped frame portion being slidably inserted into the backplane section and said second U-shaped frame portion being slidably inserted into the bottom plane section of said sleeve thereby maintaining said first U-shaped frame portion and said backplane fixed at a first included angle relative to second U-shaped frame portion and said bottom plane, said first included angle being an acute angle within a range of from 70-80 degrees, and a deployable seat rotatably affixed to said backpack, said seat further comprising a cushion having a top surface and a bottom surface forming a second angle there between, said second angle being an acute angle complementary to said first angle, said seat being configured to pivot from a sitting position in which the bottom surface of said seat extends parallel to said second U-shaped frame portion and aligned with said bottom plane to a stowed position in which the top surface of said seat extends parallel to said first U-shaped frame portion and aligned with said back-plane;

at least one fastener for securing said seat in said stowed position.

2. The dual-configuration chair of claim 1, wherein when said seat is pivoted to said stowed position the bottom surface of said cushion is oriented at a right angle to said bottom plane.

3. The dual-configuration chair of claim 2, in which said second angle is from 10° to 20°.

4. The dual-configuration chair of claim 1, in which said backplane further comprises a top edge and bottom edge and wherein said seat is affixed to said backpack at said bottom edge, said backpack further comprising a pair of shoulder straps extending from said top edge to said bottom edge of said backplane.

5. The dual-configuration chair of claim 1, in which said first U-shaped frame portion and said second U-shaped frame portion are tubular members joined at their ends by a pair of angle connectors configured for a friction fit therein.

6. A combination backpack chair, comprising:

a fabric backpack configured to define a primary storage compartment bounded by a backplane comprising a first fabric panel and a second fabric panel stitched to said first fa and a bottom plane diverging from said backplane at an acute angle, and a Sild fabric panel overlying said backplane and bottom plane to create a separate sleeve compartment running continuously along said backplane and bottom plane around said acute angle, said sleeve compartment having a back-plane sleeve onion and a bottom plane sleeve portion;

a contiguous tubular frame inserted into said sleeve compartment, said frame comprising a first planar U-shaped member having two ends and a second planar U-shaped member having two ends attached to the ends of said first member at a first included acute angle within a range of from 70°-80°, the first planar U-shaped member being received within said back-plane sleeve portion and said second planar U-shaped member being received within said bottom plane sleeve portion thereby maintaining said backplane fixed at said first included acute angle relative to said bottom plane, and;

a deployable seat pivotally affixed to said backpack, said seat further comprising a cushion having a top surface and a bottom surface forming a second acute angle within a range of from 10°-20°, said second acute angle being complementary to said first acute angle, said seat being pivotable from a sitting position in which the bottom surface of said seat extends parallel to said first planer U-shaped member and aligned with said bottom plane to a stowed position in which the top surface of said seat extends parallel to said second U-shaped frame member and aligned with said backplane; and at least one fastener for securing said seat in said stowed position.

7. The combination backpack chair of claim 6, wherein when said seat is pivoted to said stowed position the bottom surface of said cushion is oriented at a right angle to said bottom plane.

8. The combination backpack chair of claim 6, in which said backplane further comprises a top edge and bottom edge and wherein said seat is affixed to said backpack at said bottom edge, said backpack further comprising a pair of shoulder straps extending from said top edge to said bottom edge of said backplane.

9. The combination backpack chair of claim 6, in which said first U-shaped frame member and said second U-shaped frame member are tubular timbers joined at their ends by a pair of angle connectors configured for a friction fit therein.

* * * * *